US009340851B2

(12) United States Patent
Zou et al.

(10) Patent No.: US 9,340,851 B2
(45) Date of Patent: May 17, 2016

(54) DEVICE AND METHOD FOR PREPROCESSING METALLIC MAGNESIUM

(71) Applicant: Shenzhen China Star Optoelectronics Technology Co., Ltd., Shenzhen, Guangdong (CN)

(72) Inventors: Qinghua Zou, Guangdong (CN); Tsungyuan Wu, Guangdong (CN); Xindi Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 199 days.

(21) Appl. No.: 14/348,703

(22) PCT Filed: Jan. 21, 2014

(86) PCT No.: PCT/CN2014/070934
§ 371 (c)(1),
(2) Date: Mar. 31, 2014

(87) PCT Pub. No.: WO2015/100812
PCT Pub. Date: Jul. 9, 2015

(65) Prior Publication Data

US 2015/0247217 A1 Sep. 3, 2015

(51) Int. Cl.
*C22B 26/22* (2006.01)
*C22B 9/00* (2006.01)
(Continued)

(52) U.S. Cl.
CPC . *C22B 26/22* (2013.01); *C22B 4/02* (2013.01); *C22B 4/08* (2013.01); *C22B 9/00* (2013.01);
(Continued)

(58) Field of Classification Search
CPC ..... C22B 26/22; C22B 9/04; C22B 6/006; C22B 4/02; C22B 4/08; F27D 19/00; F27D 21/00; F27D 21/02; F27D 14/04
See application file for complete search history.

(56) References Cited

U.S. PATENT DOCUMENTS 2,309,644 A * 2/1943 Hansgirg ..... C22B 26/22 266/149
4,238,224 A 12/1980 Bettanini et al.
(Continued)

FOREIGN PATENT DOCUMENTS

CA 2860978 A1 * 7/2013
CN 101386919 A 3/2009
WO WO2011153683 A1 12/2011

OTHER PUBLICATIONS

Machine translation of the description for CN 101386919 published Mar. 2009.*

*Primary Examiner* — George Wyszomierski
*Assistant Examiner* — Tima M McGuthry Banks
(74) *Attorney, Agent, or Firm* — Andrew C. Cheng

(57) ABSTRACT

Provided are a device and a method for preprocessing metallic magnesium. The device includes a chamber, a heating device mounted in the chamber, a gas inlet port mounted on the chamber, and a gas evacuation port mounted on the chamber. The gas inlet port is connected to external inert gas supply equipment for supplying an inert gas into the chamber. The gas evacuation port is connected to an external vacuum evacuation device to evacuate the chamber to vacuum. The heating device functions to heat metallic magnesium having an oxidized surface so as to sublimate a layer of magnesium oxide formed on the surface of the metallic magnesium in a vacuum environment to thereby obtain pure metallic magnesium.

14 Claims, 5 Drawing Sheets

(51) Int. Cl.

| | |
|---|---|
| ***C22B 9/04*** | (2006.01) |
| ***C22B 9/05*** | (2006.01) |
| ***F27B 14/04*** | (2006.01) |
| ***F27D 21/00*** | (2006.01) |
| ***F27D 21/02*** | (2006.01) |
| ***C22B 4/02*** | (2006.01) |
| ***C22B 4/08*** | (2006.01) |
| ***C23F 4/00*** | (2006.01) |
| ***F27D 11/00*** | (2006.01) |
| ***F27D 19/00*** | (2006.01) |
| ***C23G 5/00*** | (2006.01) |
| ***F27B 5/04*** | (2006.01) |
| ***F27B 5/06*** | (2006.01) |

(52) U.S. Cl.

CPC ... *C22B 9/04* (2013.01); *C22B 9/05* (2013.01); *C23F 4/00* (2013.01); *C23G 5/00* (2013.01); *F27B 5/04* (2013.01); *F27B 5/06* (2013.01); *F27B 14/04* (2013.01); *F27D 11/00* (2013.01); *F27D 19/00* (2013.01); *F27D 21/00* (2013.01); *F27D 21/0014* (2013.01); *F27D 21/02* (2013.01); *F27D 2019/0012* (2013.01); *F27D 2019/0018* (2013.01)

(56) References Cited

U.S. PATENT DOCUMENTS

| | | | | |
|---|---|---|---|---|
| 4,518,425 | A | 5/1985 | Wynnyckyj | |
| 5,090,996 | A | 2/1992 | Cameron | |
| 5,128,515 | A * | 7/1992 | Tanaka | C23C 16/4411 118/725 |
| 2013/0152734 | A1 * | 6/2013 | Pal | C22B 4/02 75/10.33 |

* cited by examiner

DEVICE AND METHOD FOR PREPROCESSING METALLIC MAGNESIUM

BACKGROUND OF THE INVENTION

1. Field of the Invention

The present invention relates to the field of manufacture of flat panel displays, and in particular to a device and a method for preprocessing metallic magnesium that is used as a cathode of an OLED.

2. The Related Arts

An organic light-emitting diode or organic light-emitting diode display (OLED) is also referred to as an organic electroluminescent diode, which is a novel displaying technology of which the development was dated back to the middle of the 20th century. The organic electroluminescent diode has various advantages over a liquid crystal display, such as being fully solid state, active emission of light, high brightness, high contrast, being ultra thin, low cost, low power consumption, fast response, wide view angle, wide range of operation temperature, and being capable of flexible displaying. The structure of an organic electroluminescent diode generally comprises a substrate, an anode, a cathode, and an organic function layer and the principle of light emission is that multiple layers of organic materials that are of extremely small thickness is formed between the anode and the cathode through vapor deposition, whereby positive and negative carriers, when injected into the organic semiconductor films, re-combine with each other to generate light. The organic function layer of the organic electroluminescent diode is generally made up of three function layers, which are respectively a hole transport layer (HTL), an emissive layer (EML), and an electron transport layer (ETL). Each of the function layers can be a single layer or more than one layer. For example, the hole transport layer sometimes is further divided into a hole injection layer and a hole transport layer and the electron transport layer may also be divided into an electron transport layer and an electron injection layer. However, they are of substantially the same function and are thus collectively referred to as the hole transport layer and the electron transport layer.

Currently, the manufacture of a full color organic electroluminescent diode is generally done with three methods, which are RGB juxtaposition and individual emission method, white light in combination with color filter method, and color conversion method, among which the RGB juxtaposition and individual emission method is most promising and has the most practical applications. The manufacturing method thereof is that different host and guest light-emitting materials are selected for red, green, and blue colors.

The organic light-emitting diodes can be classified in two types, according to the method of driving, which are active driving and passive driving, namely direct addressing and TFT (Thin-Film Transistor) matrix addressing. The active driving type organic light-emitting diode is the so called active matrix organic light-emitting diode (AMOLED).

The currently adopted technology for small-sized AMOLED display screens is g a low-temperature poly-silicon thin-film transistor (LTPS TFT) backplane carrying a top-emission OLED of which a cathode is formed of a magnesium/silver (Mg/Ag) alloy, where Mg has a work function of −3.68 eV, while Ag has a work function of −4.26 eV, so that electrons are readily injected from the cathode into the electron transport layer. Further, the Mg/AG alloy of 10-20 nm shows excellent transmittance, allowing the light generated by by exciton transition occurring in the emissive layer to transmit out from the interior of the device.

Generally, a metal having a higher work function is more active. For example, lithium (Li) has a work function of −2.1 eV; sodium (Na) has a work function of −2.28 eV; and calcium (Ca) has a work function of −2.9 eV. A metal that is more active can be oxidized more easily. Na needs to be preserved in kerosene and, once contacting air and moisture, will generate reaction, which, if violent, may get flaming and exploded. Thus, although Mg that has a higher work function is chosen for easy use, Mg may still get oxidized in the atmosphere, forming a dense layer of magnesium oxide on the surface thereof.

In a heating and evaporating process occurring in a coating machine, magnesium oxide is released in the form of tiny particles, referred to as "magnesium ash". The magnesium ash has a very light mass and a large amount of magnesium ash existing in a chamber of the coating machine will contaminate the chamber. Most importantly, they will float and reach a substrate and cause defects on pixels, eventually resulting in dark spots in a light emission zone and affecting the service life and yield rate.

SUMMARY OF THE INVENTION

An object of the present invention is to provide a metallic magnesium preprocessing device, which has a simple structure, is effective in removing magnesium oxide from a surface of the metallic magnesium, and effectively reduce an exposed area of the metallic magnesium, so as to effectively reduce a re-oxidizable area of the metallic magnesium to increase the purity of the metallic magnesium.

Another object of the present invention is to provide a metallic magnesium preprocessing method, which involves a simple process, is effective in removing magnesium oxide from a surface of the metallic magnesium, and effectively reduce an exposed area of the metallic magnesium, so as to effectively reduce a re-oxidizable area of the metallic magnesium to increase the purity of the metallic magnesium.

To achieve the object, the present invention provides a metallic magnesium preprocessing device, which comprises: a chamber, a heating device mounted in the chamber, a gas inlet port mounted on the chamber, and a gas evacuation port mounted on the chamber. The gas inlet port is connected to and in communication with external inert gas supply equipment for supplying an inert gas into the chamber. The gas evacuation port is connected to and in communication with an external vacuum evacuation device to evacuate the chamber to vacuum. The heating device heats metallic magnesium having an oxidized surface so as to sublimate a layer of magnesium oxide formed on the surface of the metallic magnesium in a vacuum environment to thereby obtain pure metallic magnesium.

The gas inlet port is provided with a gas inlet valve for controlling opening and closing of the gas inlet port and the gas evacuation port is provided with a gas evacuation valve for controlling opening and closing of the gas evacuation port.

The metallic magnesium preprocessing device further comprises a control device, which controls actuation and de-actuation of the gas inlet valve and the gas evacuation valve.

The metallic magnesium preprocessing device further comprises an oxygen sensor arranged in the chamber and a vacuum gauge arranged in the chamber. The oxygen sensor detects oxygen content inside the chamber. The vacuum gauge detects pressure inside the chamber.

The heating device comprises a base, a heating coil arranged on the base, and a cover mounted on the base and located outside and around the heating coil. The heating coil is formed by winding an electric heating wire of an iron chromium aluminum alloy or a nickel chromium alloy. The base and the cover re both made of metals. The heating device is controlled by the control device as to whether to carry out a heating operation.

The cover receives a temperature transducer mounted therein to detect a temperature of the heating device.

The chamber comprises a lighting device mounted therein and the chamber has a sidewall in which a transparent window is formed for observation a melting condition of the surface-oxidized metallic magnesium in the chamber.

The metallic magnesium preprocessing device further comprises a lining attachment-prevention board removably mounted inside the chamber.

The control device is mounted on the chamber or integrated with a coating machine.

The present invention also provides a metallic magnesium preprocessing device, which comprises: a chamber, a heating device mounted in the chamber, a gas inlet port mounted on the chamber, and a gas evacuation port mounted on the chamber, the gas inlet port being adapted to be connected to and in communication with an external inert gas supply equipment for supplying an inert gas into the chamber, the gas evacuation port being adapted to be connected to and in communication with an external vacuum evacuation device to evacuate the chamber to vacuum, the heating device heating metallic magnesium having an oxidized surface so as to sublimate a layer of magnesium oxide formed on the surface of the metallic magnesium in a vacuum environment to thereby obtain pure metallic magnesium;

wherein the gas inlet port is provided with a gas inlet valve for controlling opening and closing of the gas inlet port and the gas evacuation port is provided with a gas evacuation valve for controlling opening and closing of the gas evacuation port;

further comprising a control device, which controls actuation and de-actuation of the gas inlet valve and the gas evacuation valve;

further comprising an oxygen sensor arranged in the chamber and a vacuum gauge arranged in the chamber, the oxygen sensor detecting oxygen content inside the chamber, the vacuum gauge detecting pressure inside the chamber; and wherein the heating device comprises a base, a heating coil arranged on the base, and a cover mounted on the base and located outside and around the heating coil, the heating coil being formed by winding an electric heating wire of an iron chromium aluminum alloy or a nickel chromium alloy, the base and the cover being both made of metals, the heating device being controlled by the control device as to whether to carry out a heating operation.

The cover receives a temperature transducer mounted therein to detect a temperature of the heating device.

The chamber comprises a lighting device mounted therein and the chamber has a sidewall in which a transparent window is formed for observation a melting condition of the surface-oxidized metallic magnesium in the chamber.

The metallic magnesium preprocessing device further comprises a lining attachment-prevention board removably mounted inside the chamber.

The control device is mounted on the chamber or integrated with a coating machine.

The present invention further provides a method for preprocessing metallic magnesium, which comprises the following steps:

(1) providing a preprocessing device, wherein the preprocessing device comprises: a chamber, a heating device mounted in the chamber, a gas inlet port mounted on the chamber, and a gas evacuation port mounted on the chamber, the gas inlet port being connected to and in communication with an external inert gas supply equipment, the gas evacuation port being connected to and in communication with an external vacuum evacuation device;

(2) placing surface-oxidized metallic magnesium in a crucible and placing the crucible on the heating device;

(3) evacuating interior of the chamber to vacuum through the gas evacuation port;

(4) introducing an inert gas into the chamber through the gas inlet port;

(5) repeating steps (3) and (4) until oxygen content inside the chamber becomes less than 1 ppm;

(6) evacuating the interior of the chamber to vacuum through the gas evacuation port so as to make an internal pressure of the chamber less than or equal to $10^{-4}$ Pa;

(7) using the heating device to heat up the surface-oxidized metallic magnesium so as to completely sublimate magnesium oxide; and (8) conducting cooling and then obtaining pure metallic magnesium;

wherein the gas inlet port is provided with a gas inlet valve for controlling opening and closing of the gas inlet port and the gas evacuation port is provided with a gas evacuation valve for controlling opening and closing of the gas evacuation port;

wherein the preprocessing device further comprises a control device, which controls actuation and de-actuation of the gas inlet valve and the gas evacuation valve;

wherein the preprocessing device further comprises an oxygen sensor arranged in the chamber and a vacuum gauge arranged in the chamber, the oxygen sensor detecting oxygen content inside the chamber, the vacuum gauge detecting pressure inside the chamber;

wherein the heating device comprises a base, a heating coil arranged on the base, and a cover mounted on the base and located outside and around the heating coil, the heating coil being formed by winding an electric heating wire of an iron chromium aluminum alloy or a nickel chromium alloy, the base and the cover being both made of metals, the heating device being controlled by the control device as to whether to carry out a heating operation;

wherein the cover receives a temperature transducer mounted therein to detect a temperature of the heating device;

wherein the chamber comprises a lighting device mounted therein and the chamber has a sidewall in which a transparent window is formed for observation a melting condition of the surface-oxidized metallic magnesium in the chamber;

wherein the preprocessing device further comprises a lining attachment-prevention board removably mounted inside the chamber; and wherein the control device is mounted on the chamber or integrated with a coating machines.

The efficacy of the present invention is that the present invention provides a device and a method for preprocessing metallic magnesium, in which precedent preprocessing is applied to remove magnesium oxide from surfaces of particles of metallic magnesium and exposed surface area of the metallic magnesium received in a crucible is greatly reduced to reduce the content of magnesium oxide so that it only needs to handle an extremely small amount of magnesium oxide in a coating chamber, preventing the coating chamber from being contaminated by a large amount of magnesium oxide and greatly reducing the chance of defect products resulting from magnesium oxide. Further, since the chamber is kept from a large amount of magnesium oxide, the number of machine shut-downs for maintenance can be reduced and the number of replacing the lining attachment-prevention board can also be reduced to thereby increase the machine utilization and save cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
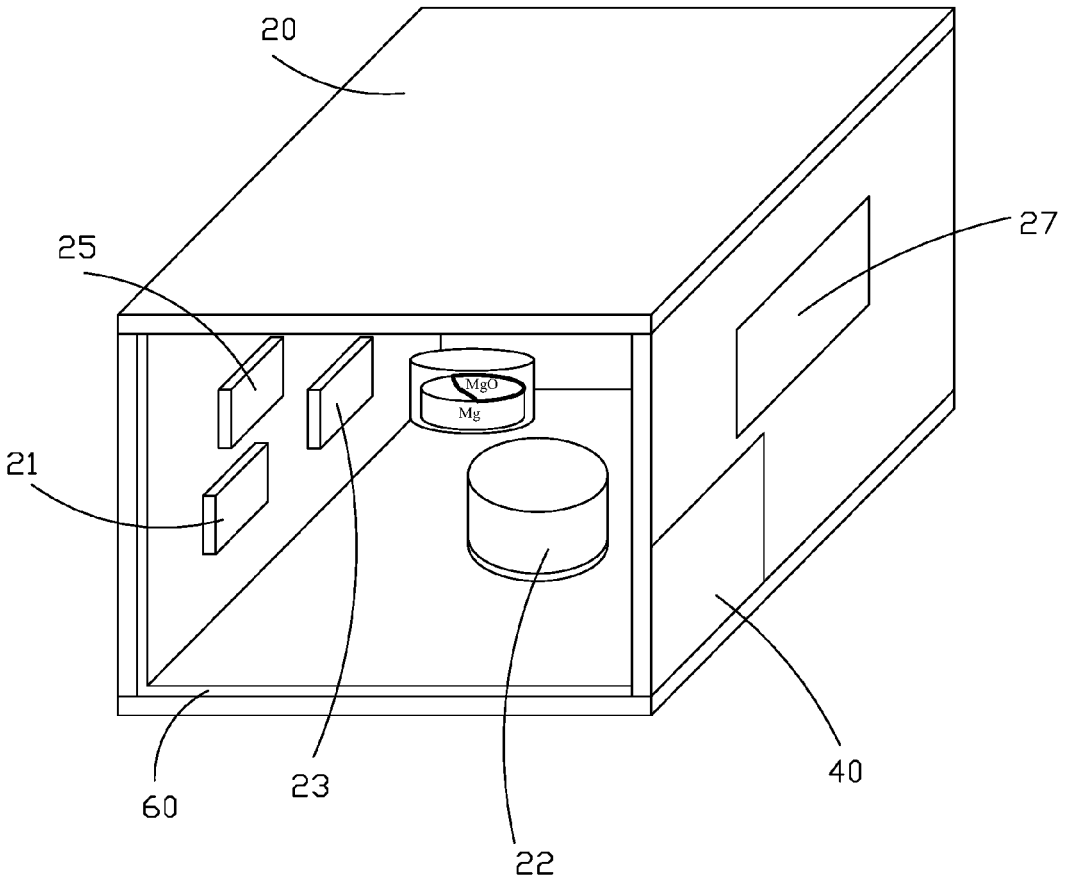
FIG. 1 is a schematic view showing the structure of a metallic magnesium preprocessing device according to the present invention.
Figure 2:
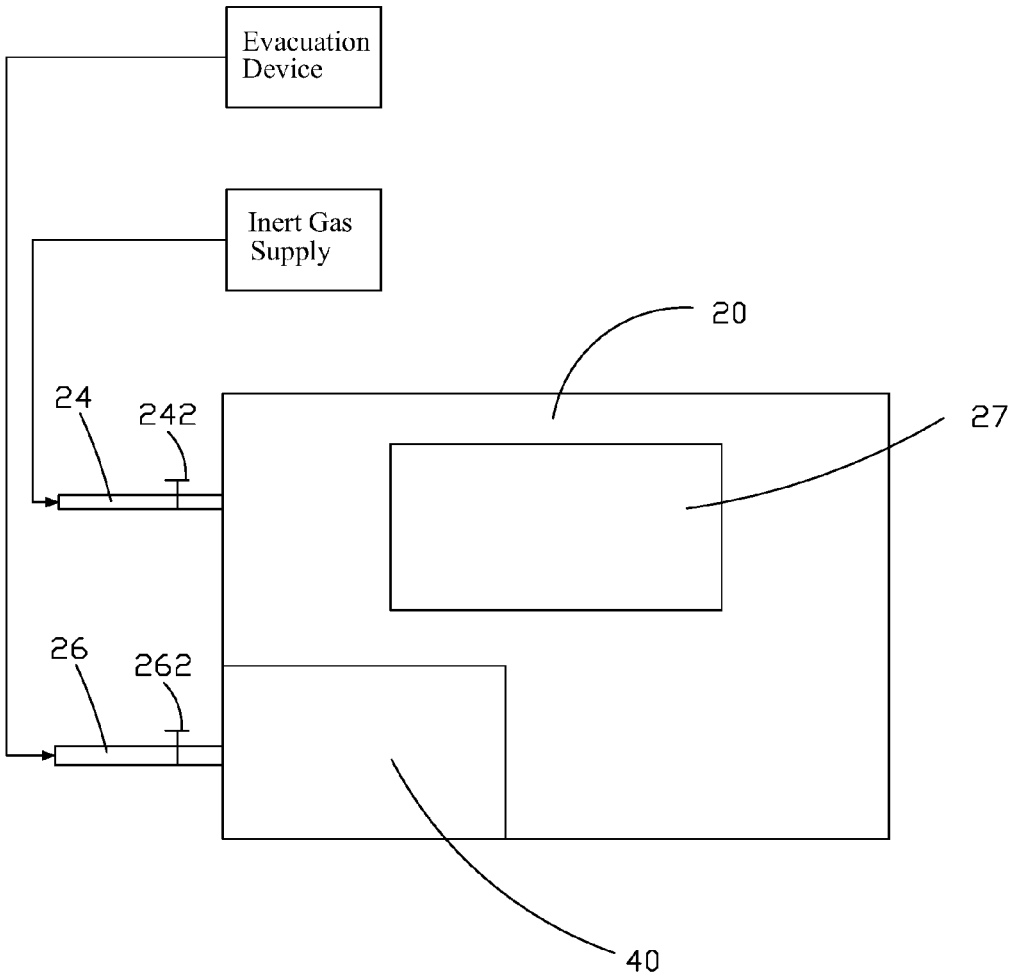
FIG. 2 is a plan view showing the structure of the metallic magnesium preprocessing device according to the present invention.
Figure 3:
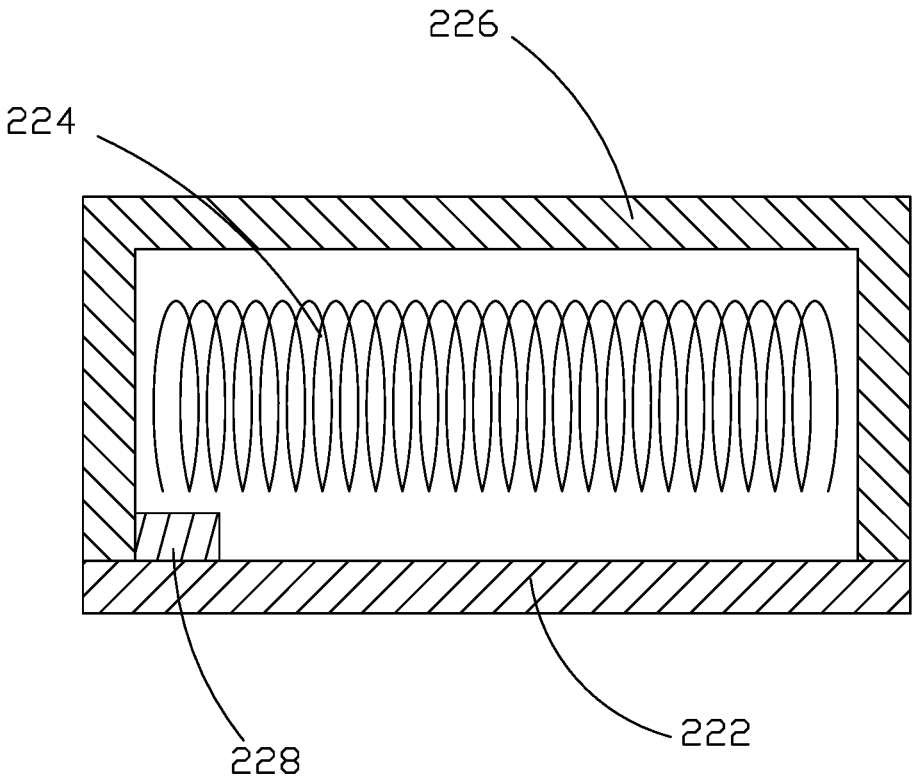
FIG. 3 is a cross-sectional view of a heating device of the metallic magnesium preprocessing device according to the present invention.

Referring to FIGS. 1-3, the present invention provides a metallic magnesium preprocessing device, which comprises: a chamber 20, a heating device 22 mounted in the chamber 20, a gas inlet port 24 mounted on the chamber 20, and a gas evacuation port 26 mounted on the chamber 20. The gas inlet port 24 is connected to and in communication with an external inert gas supply equipment (not shown) for supplying an inert gas into the chamber 20. The gas evacuation port 26 is connected to and in communication with an external vacuum evacuation device (not shown) to evacuate the chamber 20 to vacuum. The heating device 22 functions to heat metallic magnesium having an oxidized surface so as to sublimate a layer of magnesium oxide formed on the surface of the metallic magnesium in a vacuum environment to thereby obtain pure metallic magnesium. Since the preprocessing device is operated by placing the surface-oxidized metallic magnesium in a crucible (not shown), after the preprocessing, the pure metallic magnesium only has an exposed surface area that is smaller than or equal to an open area of the crucible, so that even under exposure to air, there is only the exposed surface that will be oxidized, thereby greatly reducing the oxidized area of the metallic magnesium, reducing the amount of magnesium oxide of the metallic magnesium resulting from re-oxidization, and increasing the purity of the metallic magnesium.

Specifically, the gas inlet port 24 is provided with a gas inlet valve 242 for controlling opening and closing of the gas inlet port 24 and the gas evacuation port 26 is provided with a gas evacuation valve 262 for controlling opening and closing of the gas evacuation port 26. Actuation/de-actuation of the gas inlet valve 242 and the gas evacuation valve 262 is controlled by a control device. In the instant embodiment, the control device can be a programmable logic controller (PLC), which can be directly mounted on the chamber 20 or be alternatively integrated with the coating machine (not shown). In the instant embodiment, the control device is directly mounted on the chamber 20 and is operable with a control panel 40.

In addition, the metallic magnesium preprocessing device further comprises an oxygen sensor 21 arranged in the chamber 20 and a vacuum gauge 23 arranged in the chamber 20. The oxygen sensor 21 detects oxygen content inside the chamber 20 and the vacuum gauge 23 detects the pressure inside the chamber 20 in order to ensure the oxygen content and pressure inside the chamber 20 are at predetermined levels and thus guaranteeing the purity of the metallic magnesium after the preprocessing.

The heating device 22 comprises a base 222, a heating coil 224 arranged on the base 222, and a cover 226 mounted on the base 222 and located outside and around the heating coil 224. The heating coil 224 is formed by winding an electric heating wire of an iron chromium aluminum alloy or a nickel chromium alloy. The base 222 and the cover 226 are both made of metals having good thermal conductivities. The heating device 22 is controlled by the control device as to whether to carry out a heating operation. The cover 226 receives a temperature transducer 228 mounted therein to detect the temperature of the heating device 22 for controlling the heating temperature within a predetermined range.

It is noted that the chamber 20 may further comprise a lighting device 25 mounted therein. Further, a transparent window 27 is formed in a sidewall of the chamber 20. Thus, with lighting provided by the lighting device 25, observation can be made through the transparent window 27 for the melting condition of the surface-oxidized metallic magnesium placed in the chamber 20.

In addition, the metallic magnesium preprocessing device may further comprise a lining attachment-prevention board 60 removably mounted inside the chamber 20 to receive sublimated magnesium oxide to deposit thereon and thus preventing magnesium oxide from directly attaching to inside surfaces of the chamber. Since the lining attachment-prevention board 60 is removable, after the deposition of magnesium oxide thereon reaches a predetermined amount, the lining attachment-prevention board 60 can be removed for cleaning so as to effectively extend the service life of the metallic magnesium preprocessing device.

Figure 4:
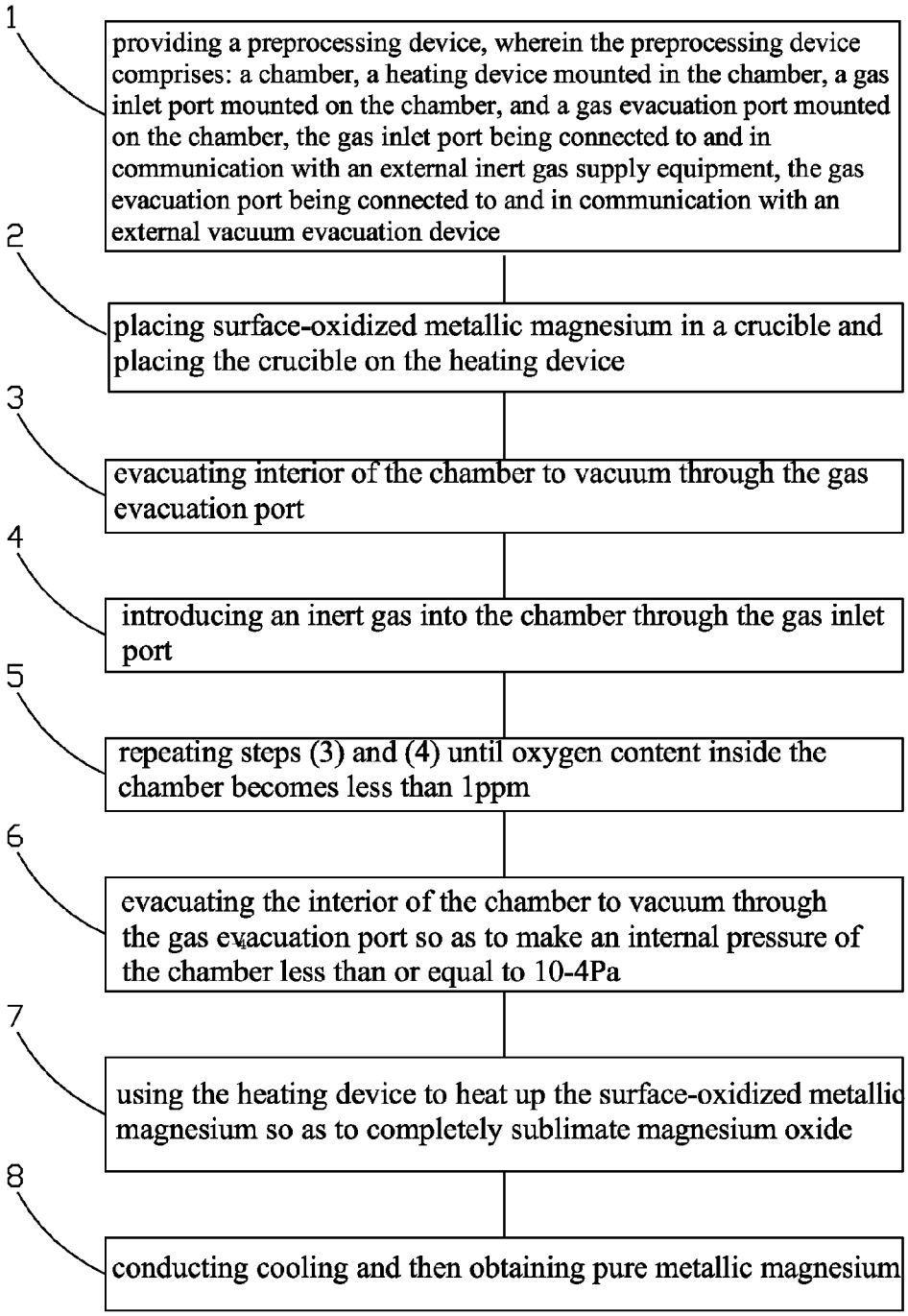
FIG. 4 is a flow chart illustrating a metallic magnesium preprocessing method according to the present invention.

Referring to FIG. 4, with additional reference to FIGS. 1-3, the present invention also provides a metallic magnesium preprocessing method, which comprises the following steps:

Step 1: providing a preprocessing device, wherein the preprocessing device comprises: a chamber 20, a heating device 22 mounted in the chamber 20, a gas inlet port 24 mounted on the chamber 20, and a gas evacuation port 26 mounted on the chamber 20. The gas inlet port 24 is connected to and in communication with external inert gas supply equipment (not shown) for supplying an inert gas into the chamber 20. The gas evacuation port 26 is connected to and in communication with an external vacuum evacuation device (not shown) to evacuate the chamber 20 to vacuum. The heating device 22 functions to heat metallic magnesium having an oxidized surface so as to sublimate a layer of magnesium oxide formed on the surface of the metallic magnesium in a vacuum environment to thereby obtain pure metallic magnesium. Since the preprocessing device is operated by placing the surface-oxidized metallic magnesium in a crucible (not shown), after the preprocessing, the pure metallic magnesium only has an exposed surface area that is smaller than or equal to an open area of the crucible, so that even under exposure to air, there is only the exposed surface that will be oxidized, thereby greatly reducing the oxidized area of the metallic magnesium, reducing the amount of magnesium oxide of the metallic magnesium resulting from re-oxidization, and increasing the purity of the metallic magnesium.

Specifically, the gas inlet port 24 is provided with a gas inlet valve 242 for controlling opening and closing of the gas inlet port 24 and the gas evacuation port 26 is provided with a gas evacuation valve 262 for controlling opening and closing of the gas evacuation port 26. Actuation/de-actuation of the gas inlet valve 242 and the gas evacuation valve 262 is controlled by a control device. In the instant embodiment, the control device can be a programmable logic controller (PLC), which can be directly mounted on the chamber 20 or be alternatively integrated with the coating machine (not shown). In the instant embodiment, the control device is directly mounted on the chamber 20 and is operable with a control panel 40.

In addition, the metallic magnesium preprocessing device further comprises an oxygen sensor 21 arranged in the chamber 20 and a vacuum gauge 23 arranged in the chamber 20. The oxygen sensor 21 detects oxygen content inside the chamber 20 and the vacuum gauge 23 the pressure inside the chamber 20 in order to ensure the oxygen content and pressure inside the chamber 20 are at predetermined levels and thus guaranteeing the purity of the metallic magnesium after the preprocessing.

The heating device 22 comprises a base 222, a heating coil 224 arranged on the base 222, and a cover 226 mounted on the base 222 and located outside and around the heating coil 224. The heating coil 224 is formed by winding an electric heating wire of an iron chromium aluminum alloy or a nickel chromium alloy. The base 222 and the cover 226 are both made of metals having good thermal conductivities. The heating device 22 is controlled by the control device as to whether to proceed with heating. The cover 226 receives a temperature transducer 228 mounted therein to detect the temperature of the heating device 22 for controlling the heating temperature within a predetermined range.

It is noted that the chamber 20 may further comprise a lighting device 25 mounted therein. Further, a transparent window 27 is formed in a sidewall of the chamber 20. Thus, with lighting provided by the lighting device 25, observation can be made through the transparent window 27 for the melting condition of the surface-oxidized metallic magnesium placed in the chamber 20.

In addition, the metallic magnesium preprocessing device may further comprise a lining attachment-prevention board 60 removably mounted inside the chamber 20 to receive sublimated magnesium oxide to deposit thereon and thus preventing magnesium oxide from directly attaching to inside surfaces of the chamber. Since the lining attachment-prevention board 60 is removable, after the deposition of magnesium oxide thereon reaches a predetermined amount, the lining attachment-prevention board 60 can be removed for cleaning so as to effectively extend the service life of the metallic magnesium preprocessing device.

Step 2: placing surface-oxidized metallic magnesium in a crucible and placing the crucible on the heating device 22.

A practical way of operation can be as follows: Particles of metallic magnesium that were purchased are filled into a magnesium crucible of a coating machine. Sine the manufacture and processing of the magnesium particles were not completely carried out in a vacuum environment and/or a protective environment of inert gas atmosphere, the magnesium particles may get contact with air. Since magnesium is an active metal and may get oxidized by oxygen contained in the air, a layer of magnesium oxide may be formed on a surface thereof.

Step 3: evacuating interior of the chamber 20 to vacuum through the gas evacuation port 26.

Specifically, a dry pump, a molecular pump, a hydraulic pump, a low temperature pump, or various combinations of different pumps can be used to evacuate the chamber.

Step 4: introducing an inert gas into the chamber 20 through the gas inlet port 24.

Step 5: repeating Step 3 and Step 4 until oxygen content inside the chamber 20 becomes less than 1 ppm.

Step 6: evacuating the interior of the chamber 20 to vacuum through the gas evacuation port 26 so as to make an internal pressure of the chamber 20 less than or equal to $10^{-4}$ Pa.

Step 7: using the heating device 22 to heat up the surface-oxidized metallic magnesium so as to completely sublimate magnesium oxide.

Figure 5:
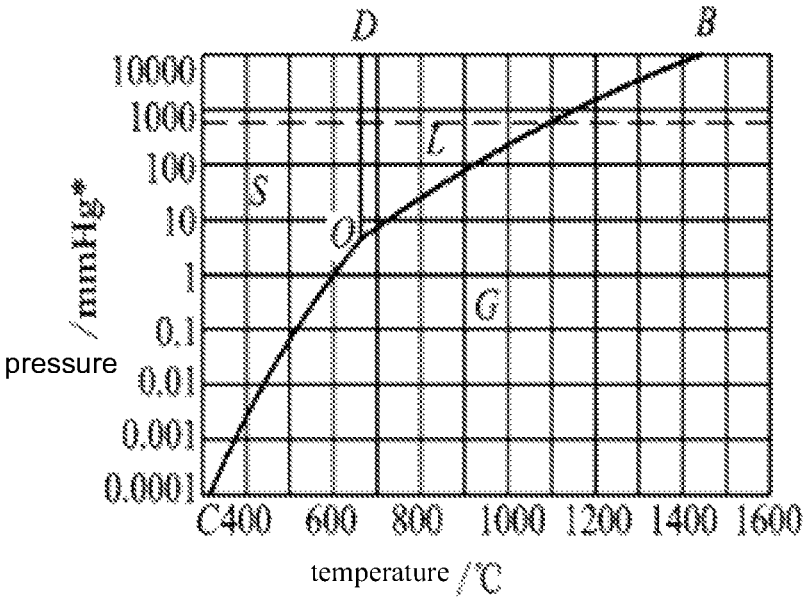
FIG. 5 is a plot showing a solid-liquid-gas conversion curve of magnesium oxide.

Referring to FIG. 5, lines OB and OC respectively designate interface lines for conversion between gas state and liquid state and solid state. During the conversions of gas/liquid and gas/solid, the variation of volume is great and the transition temperature is increased along with an increase of pressure. Line OD designates an interface line for conversion between liquid state and solid state, which is almost perpendicular to the temperature axis, meaning variation of pressure does not affect the conversion of liquid/solid. It can be seen that magnesium oxide will automatically sublimate in an environment having a pressure of $10^{-4}$ Pa and a temperature of 450-600° C.

Step 8: conducting cooling and then obtaining pure metallic magnesium.

Further, the crucible that contains magnesium so processed is placed in a heating source of the coating machine. After the chamber of the coating machine reaches a degree of vacuum that is below 1E-4, heating is started to remove minor or surface-located magnesium oxide. Afterwards, regular coating can be carried out. Under this condition, the crucible is free of magnesium oxide contained therein so that in the formation of a cathode terminal through deposition, there will be no magnesium oxide deposited in the cathode terminal, thereby generally eliminating any defect resulting from magnesium oxide.

In summary, the present invention provides a device and a method for preprocessing metallic magnesium, in which precedent preprocessing is applied to remove magnesium oxide from surfaces of particles of metallic magnesium and exposed surface area of the metallic magnesium received in a crucible is greatly reduced to reduce the content of magnesium oxide so that it only needs to handle an extremely small amount of magnesium oxide in a coating chamber, preventing the coating chamber from being contaminated by a large amount of magnesium oxide and greatly reducing the chance of defect products resulting from magnesium oxide. Further, since the chamber is kept from a large amount of magnesium oxide, the number of machine shut-downs for maintenance can be reduced and the number of replacing the lining attachment-prevention board can also be reduced to thereby increase the machine utilization and save cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A metallic magnesium preprocessing device, comprising: a chamber, a heating device mounted in the chamber, a gas inlet port mounted on the chamber, and a gas evacuation port mounted on the chamber, the gas inlet port being adapted to be connected to and in communication with an external inert gas supply equipment for supplying an inert gas into the chamber, the gas evacuation port being adapted to be connected to and in communication with an external vacuum evacuation device to evacuate the chamber to vacuum, the heating device heating metallic magnesium having an oxidized surface so as to sublimate a layer of magnesium oxide formed on the surface of the metallic magnesium in a vacuum environment to thereby obtain pure metallic magnesium; and further comprising an oxygen sensor arranged in the chamber and a vacuum gauge arranged in the chamber, the oxygen sensor detecting oxygen content inside the chamber, the vacuum gauge detecting pressure inside the chamber.

2. The metallic magnesium preprocessing device as claimed in claim 1, wherein the gas inlet port is provided with a gas inlet valve for controlling opening and closing of the gas inlet port and the gas evacuation port is provided with a gas evacuation valve for controlling opening and closing of the gas evacuation port.

3. The metallic magnesium preprocessing device as claimed in claim 2 further comprising a control device, which controls actuation and de-actuation of the gas inlet valve and the gas evacuation valve.

4. The metallic magnesium preprocessing device as claimed in claim 3, wherein the heating device comprises a base, a heating coil arranged on the base, and a cover mounted on the base and located outside and around the heating coil, the heating coil being formed by winding an electric heating wire of an iron chromium aluminum alloy or a nickel chromium alloy, the base and the cover being both made of metals, the heating device being controlled by the control device as to whether to carry out a heating operation.

5. The metallic magnesium preprocessing device as claimed in claim 4, wherein the cover receives a temperature transducer mounted therein to detect a temperature of the heating device.

6. The metallic magnesium preprocessing device as claimed in claim 3, wherein the control device is mounted on the chamber.

7. The metallic magnesium preprocessing device as claimed in claim 1, wherein the chamber comprises a lighting device mounted therein and the chamber has a sidewall in which a transparent window is formed for observation a melting condition of the surface-oxidized metallic magnesium in the chamber.

8. The metallic magnesium preprocessing device as claimed in claim 1 further comprising a lining attachment-prevention board removably mounted inside the chamber.

9. A metallic magnesium preprocessing device, comprising: a chamber, a heating device mounted in the chamber, a gas inlet port mounted on the chamber, and a gas evacuation port mounted on the chamber, the gas inlet port being adapted to be connected to and in communication with an external inert gas supply equipment for supplying an inert gas into the chamber, the gas evacuation port being adapted to be connected to and in communication with an external vacuum evacuation device to evacuate the chamber to vacuum, the heating device heating metallic magnesium having an oxidized surface so as to sublimate a layer of magnesium oxide formed on the surface of the metallic magnesium in a vacuum environment to thereby obtain pure metallic magnesium;

wherein the gas inlet port is provided with a gas inlet valve for controlling opening and closing of the gas inlet port and the gas evacuation port is provided with a gas evacuation valve for controlling opening and closing of the gas evacuation port;

further comprising a control device, which controls actuation and de-actuation of the gas inlet valve and the gas evacuation valve;

further comprising an oxygen sensor arranged in the chamber and a vacuum gauge arranged in the chamber, the oxygen sensor detecting oxygen content inside the chamber, the vacuum gauge detecting pressure inside the chamber; and wherein the heating device comprises a base, a heating coil arranged on the base, and a cover mounted on the base and located outside and around the heating coil, the heating coil being formed by winding an electric heating wire of an iron chromium aluminum alloy or a nickel chromium alloy, the base and the cover being both made of metals, the heating device being controlled by the control device as to whether to carry out a heating operation.

10. The metallic magnesium preprocessing device as claimed in claim 9, wherein the cover receives a temperature transducer mounted therein to detect a temperature of the heating device.

11. The metallic magnesium preprocessing device as claimed in claim 9, wherein the chamber comprises a lighting device mounted therein and the chamber has a sidewall in which a transparent window is formed for observation a melting condition of the surface-oxidized metallic magnesium in the chamber.

12. The metallic magnesium preprocessing device as claimed in claim 9 further comprising a lining attachment-prevention board removably mounted inside the chamber.

13. The metallic magnesium preprocessing device as claimed in claim 9, wherein the control device is mounted on the chamber.

14. A method for preprocessing metallic magnesium, comprising the following steps:

(1) providing a preprocessing device, wherein the preprocessing device comprises: a chamber, a heating device mounted in the chamber, a gas inlet port mounted on the chamber, and a gas evacuation port mounted on the chamber, the gas inlet port being connected to and in communication with an external inert gas supply equipment, the gas evacuation port being connected to and in communication with an external vacuum evacuation device;

(2) placing surface-oxidized metallic magnesium in a crucible and placing the crucible on the heating device;

(3) evacuating interior of the chamber to vacuum through the gas evacuation port;

(4) introducing an inert gas into the chamber through the gas inlet port;

(5) repeating steps (3) and (4) until oxygen content inside the chamber becomes less than 1 ppm;

(6) evacuating the interior of the chamber to vacuum through the gas evacuation port so as to make an internal pressure of the chamber less than or equal to $10^{-4}$ Pa;

(7) using the heating device to heat up the surface-oxidized metallic magnesium so as to completely sublimate magnesium oxide; and (8) conducting cooling and then obtaining pure metallic magnesium;

wherein the gas inlet port is provided with a gas inlet valve for controlling opening and closing of the gas inlet port and the gas evacuation port is provided with a gas evacuation valve for controlling opening and closing of the gas evacuation port;

wherein the preprocessing device further comprises a control device, which controls actuation and de-actuation of the gas inlet valve and the gas evacuation valve;

wherein the preprocessing device further comprises an oxygen sensor arranged in the chamber and a vacuum gauge arranged in the chamber, the oxygen sensor detecting oxygen content inside the chamber, the vacuum gauge detecting pressure inside the chamber;

wherein the heating device comprises a base, a heating coil arranged on the base, and a cover mounted on the base and located outside and around the heating coil, the heating coil being formed by winding an electric heating wire of an iron chromium aluminum alloy or a nickel chromium alloy, the base and the cover being both made of metals, the heating device being controlled by the control device as to whether to carry out a heating operation;

wherein the cover receives a temperature transducer mounted therein to detect a temperature of the heating device;

wherein the chamber comprises a lighting device mounted therein and the chamber has a sidewall in which a transparent window is formed for observation a melting condition of the surface-oxidized metallic magnesium in the chamber;

wherein the preprocessing device further comprises a lining attachment-prevention board removably mounted inside the chamber; and wherein the control device is mounted on the chamber.

* * * * *